US011804354B2

(12) United States Patent
Loesch et al.

(10) Patent No.: US 11,804,354 B2
(45) Date of Patent: Oct. 31, 2023

(54) X-RAY SOURCE DEVICE COMPRISING AN ANODE FOR GENERATING X-RAYS

(71) Applicant: Siemens Healthcare GmbH, Erlangen (DE)

(72) Inventors: Christian Loesch, Erlangen (DE); Matthias Seufert, Pettstadt (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 197 days.

(21) Appl. No.: 17/372,960

(22) Filed: Jul. 12, 2021

(65) Prior Publication Data

US 2022/0020555 A1 Jan. 20, 2022

(30) Foreign Application Priority Data

Jul. 17, 2020 (DE) ..... 10 2020 208 976.0

(51) Int. Cl.
*H01J 35/10* (2006.01)

(52) U.S. Cl.
CPC ..... *H01J 35/101* (2013.01); *H01J 35/106* (2013.01); *H01J 2235/1026* (2013.01); *H01J 2235/1204* (2013.01)

(58) Field of Classification Search
CPC ..... H01J 35/101; H01J 35/106; H01J 2235/1026; H01J 2235/1204
See application file for complete search history.

(56) References Cited

U.S. PATENT DOCUMENTS

| | | | | |
|---|---|---|---|---|
| 4,734,927 | A | 3/1988 | Leguen et al. | |
| 4,841,557 | A * | 6/1989 | Haberrecker | H01J 35/106 378/127 |
| 7,197,119 | B2 | 3/2007 | Freudenberger et al. | |
| 2002/0141538 | A1 * | 10/2002 | Nakamuta | H01J 35/1024 378/132 |
| 2018/0075999 | A1 | 3/2018 | Freudenberger et al. | |

FOREIGN PATENT DOCUMENTS

| | | | |
|---|---|---|---|
| CN | 207602513 | U | 7/2018 |
| DE | 3545047 | A1 | 7/1986 |
| DE | 102016217423 | A1 | 3/2018 |
| JP | H1040841 | A | 2/1998 |

OTHER PUBLICATIONS

German Office Action dated May 17, 2021.

* cited by examiner

*Primary Examiner* — Chih-Cheng Kao
(74) *Attorney, Agent, or Firm* — Harness, Dickey & Pierce, P.L.C.

(57) ABSTRACT

An X-ray source device includes an anode to generate X-rays; a drive to rotate the anode about an anode central axis, the drive including a stator and a first rotor, and the first rotor being rotationally fixed relative to the anode; and a cooling facility to cool at least one of the anode and the drive using a coolant. The drive includes a second rotor to circulate the coolant.

23 Claims, 3 Drawing Sheets

X-RAY SOURCE DEVICE COMPRISING AN ANODE FOR GENERATING X-RAYS

PRIORITY STATEMENT

The present application hereby claims priority under 35 U.S.C. § 119 to German patent application number DE 102020208976.0 filed Jul. 17, 2020, the entire contents of which are hereby incorporated herein by reference.

FIELD

Example embodiments of the invention generally relate to an X-ray source device comprising an anode for generating X-rays, having a drive for rotating the anode about an anode central axis, said drive comprising a stator and a first rotor, wherein the first rotor is rotationally fixed relative to the anode, wherein a cooling facility is present for cooling the anode and/or the drive by way of a coolant.

BACKGROUND

X-rays for technical or medical use are typically generated via an electron beam incident on an anode. The point of incidence of the electron beam is called the focal spot.

The energy introduced into the anode by the electron beam produces not only an emission of X-rays but also significant heating of the anode.

So-called rotating anodes are often used which can be caused to rotate via a drive. The energy of the electron beam is introduced into the anode in a ring shape by the rotation of the anode and a (from an external perspective) stationary focal spot disposed outside the anode central axis or axis of rotation. This provides improved spatial energy distribution on the anode and not only stationary point-wise heating of the anode at the focal spot. At the same time, however, the drive of the anode also generates waste heat.

For the purpose of cooling the anode and/or the drive, cooling facilities are used to dissipate the waste heat generated during operation of the X-ray source device to the environment.

A cooling facility comprising a cooling circuit is usually mounted outside an external housing of the X-ray source device and requires a relatively large amount of installation space. Moreover, this space cannot be used efficiently, since the required components, e.g. the tubes, cannot be installed in any compact manner due to the necessary bending radii.

In addition, with such cooling facility components disposed outside the external housing, not only the weight and space requirement of the additional tubes and connecting elements is disadvantageous, but the additional weight of the coolant present in the tubes also contributes to an increased overall weight of the X-ray source device.

A facility for cooling an anode of an X-ray tube is known, for example, from DE 10 2016 217 423 A1. Here, different cooling circuits are used to provide advantageous cooling for the X-ray tube.

U.S. Pat. No. 7,197,119 B2 discloses a rotary piston X-ray tube in which the rear side of the rotary anode, which is designed as part of the tube housing, is cooled directly by a static cooling medium in the emitter housing.

SUMMARY

At least one embodiment of the invention provides a compact and efficient cooling system for an X-ray source device.

At least one embodiment of the invention is directed to an X-ray source device. The X-ray source device comprises an anode for generating X-rays, a drive for rotating the anode about an anode central axis, and a cooling facility for cooling the anode and/or the drive via a coolant, wherein the drive comprises a stator and a first rotor, wherein the first rotor is rotationally fixed relative to the anode, wherein the drive comprises a second rotor which is designed to circulate the coolant.

At least one embodiment of the invention is directed to an X-ray source device, comprising:

an anode to generate X-rays;

a drive to rotate the anode about an anode central axis, the drive including a stator and a first rotor, and the first rotor being rotationally fixed relative to the anode; and a cooling facility to cool at least one of the anode and the drive using a coolant, wherein the drive includes a second rotor to circulate the coolant.

BRIEF DESCRIPTION OF THE DRAWINGS

By way of example, the invention will now be explained with reference to embodiment variants.

Figure 1:
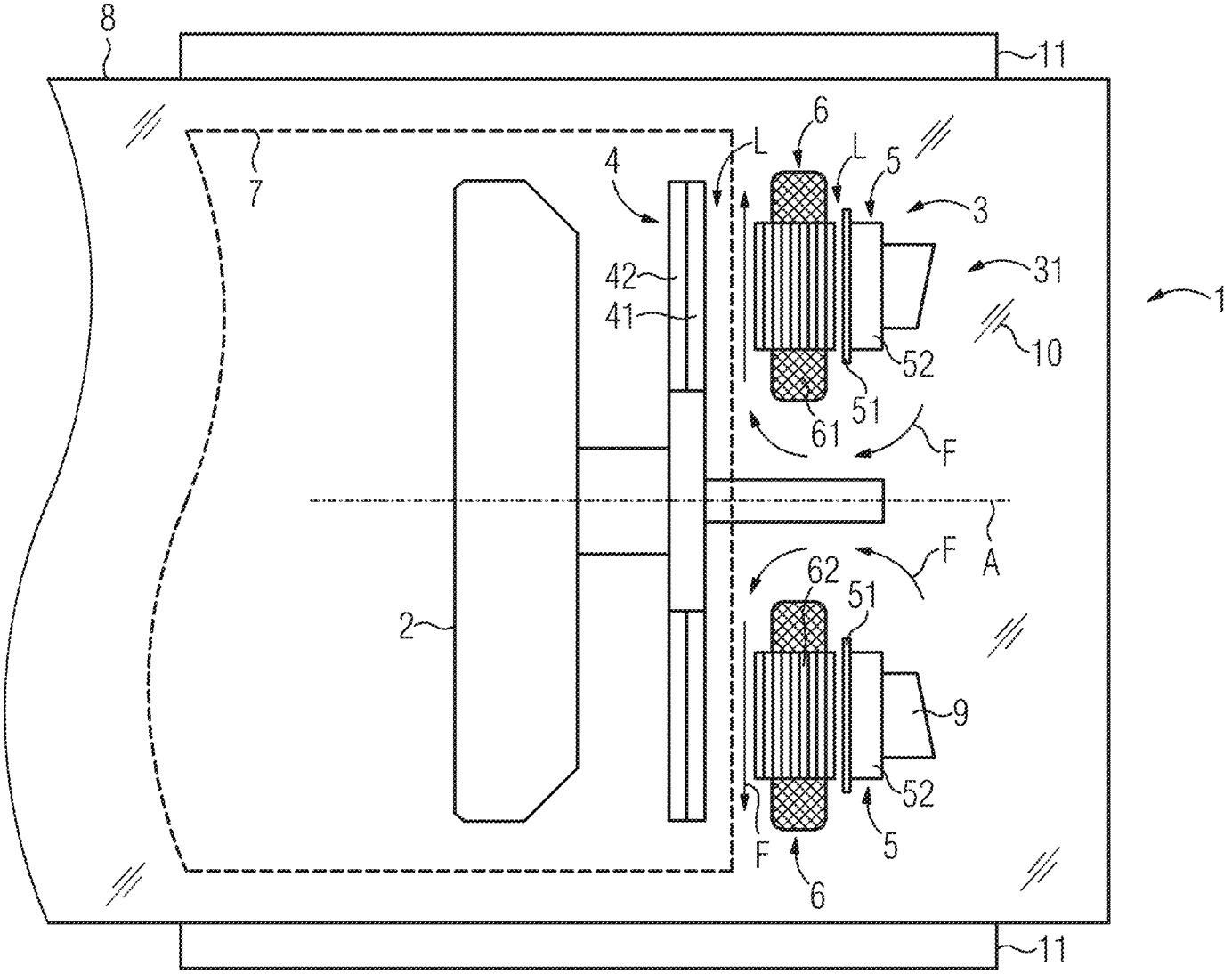
FIG. 1 schematically illustrates an X-ray source device having a drive designed as an axial flow machine, FIG. 2 schematically illustrates an X-ray source device having a drive designed as a radial flux machine according to a first embodiment variant, FIG. 3 schematically illustrates an X-ray source device having a drive designed as a radial flux machine according to a second embodiment variant.

In the figures, there the same reference signs are used to denote identical components.

DETAILED DESCRIPTION OF THE EXAMPLE EMBODIMENTS

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. At least one embodiment of the present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment of the invention is directed to an X-ray source device. The X-ray source device comprises an anode for generating X-rays, a drive for rotating the anode about an anode central axis, and a cooling facility for cooling the anode and/or the drive via a coolant, wherein the drive comprises a stator and a first rotor, wherein the first rotor is rotationally fixed relative to the anode, wherein the drive comprises a second rotor which is designed to circulate the coolant.

The aforemention embodiment makes it possible to implement an X-ray source device in which the cooling facility is essentially disposed entirely inside an external housing of the X-ray source device. Cooling components disposed on the exterior of the X-ray source device can be largely or completely eliminated.

In addition, the aforemention embodiment presented allows effective cooling of the anode and the anode drive. In particular, at least one embodiment of the inventive teaching makes it possible to significantly reduce the installation space for an X-ray source cooling facility, as well as the weight and complexity of the cooling facility. At the same time, the smaller number of components required reduces costs and assembly work.

In particular, the first rotor and the second rotor interact with the same stator.

In particular, the second rotor can be regarded as a replacement for a stator yoke, so that by replacing the stator yoke with the second rotor, there is essentially no increase in weight of the X-ray source device. In particular, the second rotor can also be driven by way of the stray field of the stator, while the anode can be rotated via the first rotor.

In particular, the first rotor, the stator and the second rotor can be enclosed by the external housing in a coolant-tight manner. In particular, the second rotor and possibly also the stator can be in direct contact with the coolant, so that the second rotor can set the coolant in motion directly by its rotation.

In an advantageous embodiment of the invention, the second rotor comprises at least one circulating element which causes the coolant to circulate when the rotor rotates. Such a circulating element can be designed e.g. as a vane, fin, disk, slot apertures or the like. The circulating element is designed to propel or move the coolant with the aim of providing improved heat dissipation from the drive and anode.

The at least one circulating element is preferably disposed on the rotor in such a way that a desired coolant flow is established within the X-ray source device. In particular, the at least one circulating element can be disposed, for example, on an outer and/or inner radius of the second rotor, e.g. on a magnetic return path encompassed by the second rotor.

In a further embodiment of the X-ray source device, the anode and the first rotor are disposed inside an evacuable housing, in particular an evacuated housing, and the stator and the second rotor are each disposed outside the housing. This arrangement is advantageous, as the anode must be disposed within a vacuum at least during operation. An evacuable housing is to be understood as meaning a housing which, by way of one-time or continuous evacuation, is suitable for obtaining a vacuum appropriate for generating X-rays.

Via the housing, the X-ray source device is thus separated into a plurality of partial volumes. The anode and the first rotor for driving the anode are preferably disposed in the first partial volume, the evacuable or rather evacuated partial volume. The stator and the second rotor are preferably disposed in the second partial volume, separated from the first by the housing.

The second partial volume can in particular be filled, in particular completely filled, with coolant which surrounds or flows around at least the second rotor, possibly also the stator.

In a further advantageous embodiment of the X-ray source device, the at least one circulating element is designed such that, when the second rotor rotates, the coolant can be moved along the housing at least section by section, in particular in a laminar manner, via the at least one circulating element. With regard to effective dissipation of the waste heat, it is advantageous if the coolant can be moved via the circulation elements, preferably in a laminar manner, over a comparatively long section of the heated housing. In this way, an effective indirect heat exchange between the anode or first rotor and the coolant can be implemented via the housing.

If necessary, guiding device(s) which support or provide a laminar coolant flow along a housing wall can also be provided for guiding the coolant on the housing.

In a further embodiment of the X-ray source device, a first air gap is provided between the stator and the first rotor, wherein a second air gap is provided between the stator and the second rotor, wherein the first air gap has a width that is greater than the width of the second air gap. Thus, the distance of the rotors from the stator, which corresponds to the width of the air gap, can be flexibly adjusted. In particular, if the stator and the second rotor are at the same electrical potential, the air gap, i.e. the distance between the stator and the second rotor, can be significantly smaller than between the stator and the first rotor. In particular, the width of the second air gap can be 0.01 to 0.5 times the width of the first air gap. The different dimensioning of the width of the first and second air gap allows a compact arrangement of the stator and the second rotor, in particular outside the evacuable or evacuated housing.

In a further embodiment variant of the X-ray source device, the drive is designed as an axial flux machine and, in the direction of the anode central axis, the first rotor is disposed on a side of the stator close to the anode and the second rotor is disposed on a side of the stator remote from the anode. This is an advantageously compact design in respect of the implementation of the drive as a double-rotor axial flux machine.

According to another advantageous embodiment of the X-ray source device, the drive is designed as a radial flux machine, wherein the anode central axis is essentially identical to an axis of rotation of the first rotor, wherein the stator encloses the first rotor radially with respect to the anode central axis, wherein the second rotor encloses the stator radially, i.e. in radial direction, with respect to the anode central axis. This allows a compact design of a double-rotor radial flux machine in the axial direction of the anode central axis.

In an alternative embodiment of the X-ray source device, the drive is designed as a radial flux machine and the anode central axis is essentially identical to an axis of rotation of the first rotor, wherein the stator encloses the first rotor radially with respect to the anode central axis, wherein the second rotor is disposed radially, i.e. in the radial direction, between the first rotor and the stator, in particular outside a housing. This makes it possible to implement an even more compact design in the axial direction as well as in the radial direction of the anode central axis.

In a further advantageous embodiment of the X-ray source device, the first rotor, the second rotor and the stator are enclosed by an external housing which isolates the X-ray source device from the environment, wherein the external housing comprises at least one heat exchange element, wherein the heat exchange element is designed to dissipate heat supplied to it by the coolant to the environment. The purpose of the heat exchange element is to ensure an advantageous heat transfer from the coolant to the environment. The heat transfer element can be designed as a cooling fin or similar. Different types of heat exchange elements can also be combined.

The X-ray source device is preferably designed to be coolant-tight. For example, the external housing can enclose all the other essential components of the X-ray source device in a liquid-tight manner. If necessary, the external housing can also cooperate with other components of the X-ray source device, such as the evacuable or evacuated housing, in order to make the X-ray source device liquid-tight.

In another variant of the X-ray source device, the anode and the first rotor are disposed within an evacuable or evacuated housing, wherein the second rotor is disposed outside the housing and inside an external housing, wherein the housing and the external housing together form a coolant-tight internal space, wherein this internal space is filled with coolant, wherein at least the second rotor is mounted within the coolant, wherein the second rotor encloses at least one circulating element by which the coolant can be moved at least in sections along the housing, in particular in a laminar manner, when the second rotor rotates, wherein the coolant is guided in such a way that, after passing through the housing, it flows away in the direction of the external housing, in particular in the direction of a heat exchange element disposed on the external housing.

FIG. 1 shows a schematic view of an X-ray source device 1. This comprises an anode 2 by which X-rays are generated during operation of the X-ray source device 1. The anode 2 is rotatable about an anode central axis A via a drive 3.

As shown in FIG. 1, the drive 3 is designed as an axial flux machine 31, in particular as an axial flux asynchronous motor. Axial flux machine 31 is to be understood as meaning an electric motor in which the magnetic flux is along an axis of rotation, in FIG. 1 identical to the anode central axis A, of a first rotor 4 of the axial flux machine 31.

In addition to the first rotor 4, the axial flux machine 31 also comprises a second rotor 5 and a stator 6. The first and the second rotor 4,5 comprise, in addition to rotor conductors 41 and 51 respectively, components 42 and 52 respectively for guiding the magnetic flux. Rotation of the rotors 4,5 is made possible by interaction of the respective rotor conductor 41,51 with the stator 6. The stator 6 comprises—shown schematically—a conductor winding 61 and a laminated core 62 for generating an axial magnetic flux.

As shown in FIG. 1, the first rotor 4—viewed in the direction of the anode central axis A—is disposed closer to the anode 2 than the rotor 5. In particular, the stator 6—viewed in the direction of the anode central axis A—is disposed between the first and second rotors 4,5. In particular, the rotor 4 is disposed in a position close to the anode and the rotor 5 in a position remote from the anode.

Rotary motion of the first rotor 4 can be produced by interaction of the first rotor 4 with the stator 6. The anode 2 is operatively connected to the first rotor 4 in such a way that the rotary motion of the first rotor 4 can be transmitted to the anode 2. The first rotor 4 and the anode 2 are preferably designed to be rotationally rigid relative to each other, e.g. interconnected via a shaft. The first rotor 4 is thus used to drive the rotation of the anode 2.

The second rotor 5, which interacts with the same stator 6 as the first rotor 4, is designed to provide effective and compact cooling of the X-ray source device 1, i.e. to act as a cooling pump or coolant pump.

The anode 2, the electron source and electron optics (not shown in the figures), and the first rotor 4 are disposed inside, i.e. enclosed by, an evacuable or rather evacuated housing 7. A sufficient vacuum must be provided for the anode 2 at least during operation of the X-ray source device 1.

The stator 6 and the second rotor 5 are disposed outside the evacuable or evacuated housing 7. The stator 6 and the second rotor 5 are in turn disposed inside an external housing 8 of the X-ray source device 1, i.e. in an internal space formed by the housing 7 and the external housing 8. This internal space is filled with coolant 10, i.e. the stator 6 and the second rotor 5 are surrounded by coolant 10. The internal space formed by the external housing 8 and the housing 7 is also designed to be coolant-tight.

The coolant 10 is used to absorb the waste heat generated e.g. by the anode 2 or the components of the drive 3. Insofar as the components are completely enclosed by the housing 1, i.e. are disposed within the evacuable or evacuated housing 1, cooling is effected by the cooling of the housing 1. A possible coolant 10 is heat-resistant oil, for example.

For effective removal of the heat given off by the drive 3 and the anode 2, it is of considerable advantage if the coolant 10 is in motion, i.e. the coolant 10 should flow around the heat-emitting components as far as possible and the absorbed heat should be transferred at least partially, but preferably completely, to the external housing 8 or more specifically to at least one heat exchange element 11 disposed on the external housing 8. Preferably, a plurality of heat exchange elements 11 are disposed on the external housing 8. The external housing 8 or more specifically the heat exchange elements 11 are used to dissipate the heat to the environment of the X-ray source device 1.

In order to achieve a controlled and perceptible coolant flow, the second rotor 5 comprises a plurality of circulating elements 9. When the second rotor 5 rotates by interacting with the stray magnetic field generated by the stator 6 during operation, the coolant 10 is moved in the internal space between the housing 7 and the external housing 8 via the circulating elements 9.

As shown in FIG. 1, the circulating elements 9 are implemented as vanes; however, other types/shapes of circulating elements 9 are also possible. The important factor is that the circulating element causes the coolant to move, preferably in a particular direction and/or at a desired speed. The direction and/or speed of the cooling medium enables waste heat transfer within the X-ray source device 1 to be controlled.

The second rotor 5 is disposed relative to the housing 7 in such a way and the at least one circulating element 9 is disposed on the second rotor 5 such that, when the second rotor 5 rotates, a laminar flow of the coolant 10 is established at least along a section of the housing 7. In this way, the waste heat of the housing is effectively absorbed by the coolant 10. If necessary, guiding device(s) can also be provided on the housing 7 to generate or support a laminar coolant flow and to guide it in a targeted manner.

Preferably, a flow of the coolant 10 is established during operation in such a way that the coolant 10 heated by the housing 7 flows in the direction of the external housing 8. In particular, the internal space of the external housing or the housing 7 can be shaped or designed in such a way that during operation of the X-ray source device 1 the coolant 10 is guided to at least one heat exchange element 11 disposed on the external housing 8.

The heat is transferred from the coolant to the environment via a plurality of heat exchange elements 11. As shown in FIG. 1, heat exchange elements 11 are designed as fins which are disposed on a side of the external housing 8 facing the environment. The fins serve to provide an increased surface area for heat exchange. However, other types of heat exchange elements can also be used, in particular these can also be designed as active heat pumps, such as Peltier elements, in order to increase the cooling capacity.

The axial flux machine 31 according to FIG. 1 also allows a particularly compact design, particularly in the radial direction of the anode central axis A, since an air gap L between stator 6 and second rotor 5 can be selected significantly smaller than the air gap L between first rotor 4 and stator 6.

Figure 2:
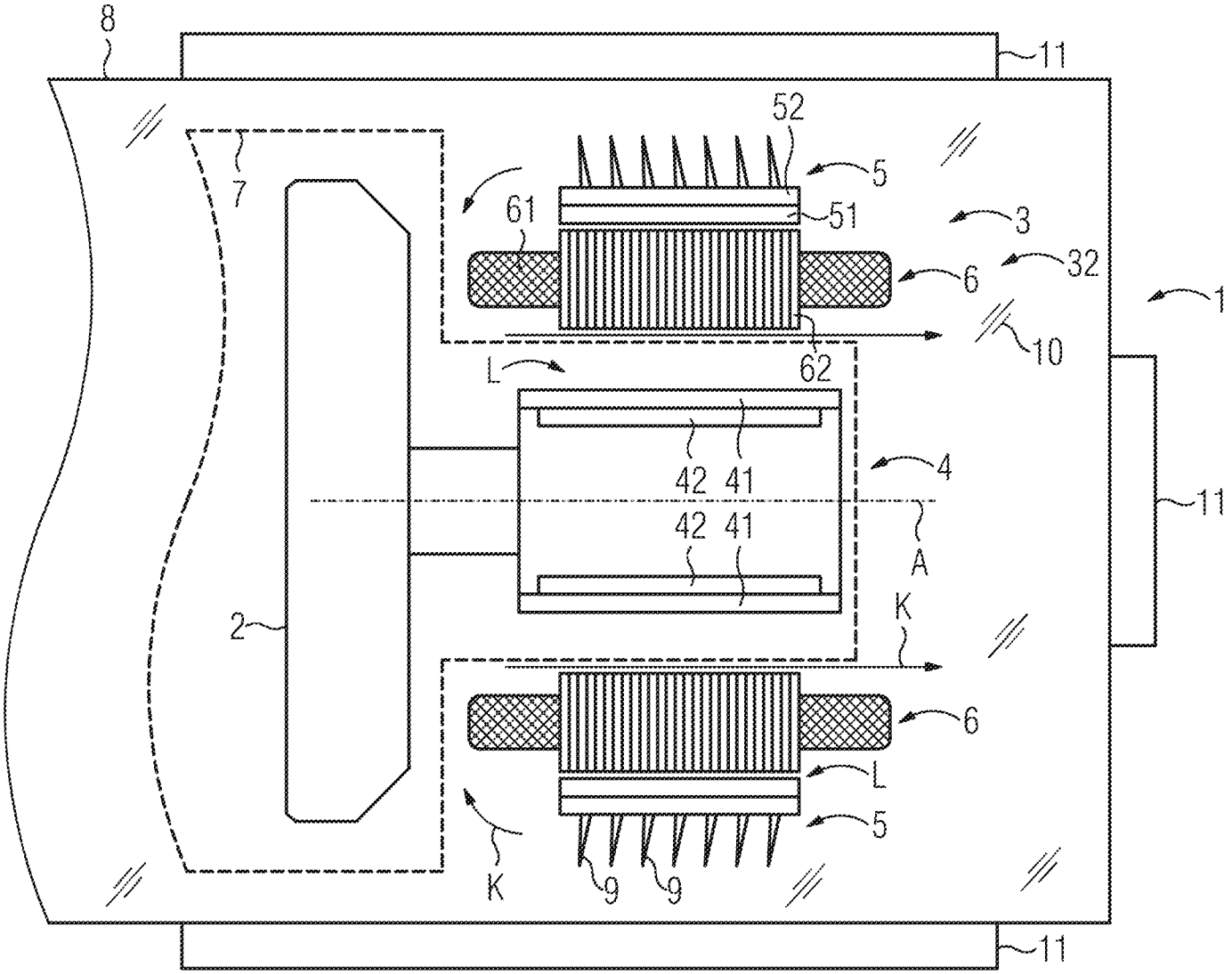

FIG. 2 shows a schematic view of another X-ray source device 1 comprising an anode 2 which is rotatable about an anode central axis A via a drive 3.

As shown in FIG. 2, the drive 3 is designed as a radial flux machine 32. Radial flux machine 32 is to be understood as meaning an electric motor in which the magnetic flux is radial to an axis of rotation, in FIG. 1 identical to the anode central axis A, of a rotor 4 of the radial flux machine 32.

In addition to the first rotor 4, the radial flux machine 32 also comprises a second rotor 5 and a stator 6. The first and second rotors 4 and 5 comprise, in addition to a rotor conductor 41 and 51 respectively, components 42 and 52 respectively for guiding the magnetic flux. The stator 6 comprises a corresponding conductor winding 61 and a laminated core 62 for generating a radial magnetic flux. Interaction of the respective rotor conductor 41,51 with the magnetic field generated by the stator enables the respective rotor 4,5 to be rotated about the anode central axis A.

As shown in FIG. 2, the stator 6 encloses the first rotor 4 radially with respect to the axis of rotation of the first rotor 4. For example, it is disposed concentrically to the first rotor 4 and an inner diameter of the stator 6 is larger than an outer diameter of the first rotor 4. In addition, the second rotor 5 is disposed radially farther to the outside than the stator 6 and in turn encloses it. This results in a "concentric arrangement" of the first rotor 4, the stator 6 and the second rotor 5 around the axis of rotation of the first rotor 4, here identical to the anode central axis A.

Via the first rotor 4, rotation of the first rotor 4 can be generated by interaction with the stator 6. The anode 2 is operatively connected to the first rotor 4 in such a way that the rotary motion of the first rotor 4 can be transmitted to the anode 2. The first rotor 4 and the anode 2 are preferably designed to be rotationally rigid relative to one other, e.g. connected via a shaft. The first rotor 4 serves to drive the rotation for the anode 2.

The second rotor 5, which interacts with the same stator 6 as the first rotor 4, is designed to provide effective and compact cooling of the X-ray source device 1, i.e. to act as a cooling pump or coolant pump.

The anode 2, the electron source and electron optics (not shown in FIG. 2), and the first rotor 4 are disposed inside, i.e. enclosed by, an evacuable or evacuated housing 7. At least during operation of the X-ray source device 1, a sufficient vacuum must be provided for the anode 2, i.e. in the internal space enclosed by the housing 7.

The stator 6 and the second rotor 5 are disposed outside the evacuable or evacuated housing 7. The stator 6 and the second rotor 5 are also enclosed by an external housing 8 of the X-ray source device 1, i.e. in an internal space formed by the housing 7 and the external housing 8. This internal space is filled with coolant 10, preferably a liquid medium. The stator 6 and the second rotor 5 are surrounded by coolant 10 and are in direct contact with it. The internal space formed by the external housing 8 together with the housing 7 is also designed to be coolant-tight.

The coolant 10 is used to absorb the waste heat generated, e.g. by the anode 2 or the components of the drive 3. Insofar as the components are completely enclosed by the housing 7, i.e. are disposed inside the evacuable or evacuated housing 7, cooling is effected by the cooling of the housing 7. Heat-resistant oil, for example, is a possible coolant.

For effective removal of the heat given off by the drive 3 and the anode 2 it is of considerable advantage if the coolant 10 is in motion, i.e. that the coolant 10 should flow around the heat-emitting components as far as possible and should transfer the absorbed heat at least partially, ideally completely, to the external housing 8 or to one or more heat exchange elements 11. Via the external housing 8 or more specifically the heat exchange elements 11, the heat is then dissipated to the environment of the X-ray source device 1.

In order to provide a controlled and perceptible flow of the coolant 10 in the internal space, the second rotor 5 comprises a plurality of circulating elements 9. If the second rotor 5 rotates by interacting with the stator 6 during operation, the coolant 10 is moved in the internal space between the housing 7 and the external housing 8 via the circulating elements 9.

As shown FIG. 2, the circulating elements 9 are designed as vanes or fins oriented and disposed on the second rotor 5 in such a way that during operation a desired coolant flow is established, particularly in respect of flow velocity and flow direction; however, other types/shapes of circulating elements 9 are also possible.

The second rotor 5 is disposed relative to the housing 7 in such a way and the at least one circulating element 9 is disposed on the second rotor 5 in such a way that during operation of the X-ray source device 1, a laminar flow of the coolant 10 is established at least along a section of the housing 7. The waste heat of the housing is thereby effectively absorbed by the coolant 10 and then reliably transported away from the housing 7. If necessary, guiding device(s) can be provided on the housing 7 in order to generate and guide a laminar coolant flow in a targeted manner.

A plurality of heat exchange elements 11 are used to dissipate the heat from the coolant to the environment. As shown in FIG. 1, heat exchange elements are designed as fins which are disposed on a side of the external housing 8 facing the environment. The fins serve to provide an increased surface area for heat exchange. However, other types of heat exchange elements can also be used, in particular these can also be implemented as active heat pumps in order to increase the cooling capacity.

The radial flux machine 32 according to FIG. 2 also permits a particularly compact design, since here too an air gap L between stator 6 and second rotor 5 can be selected significantly smaller than the air gap L between first rotor 4 and stator 6.

Figure 3:
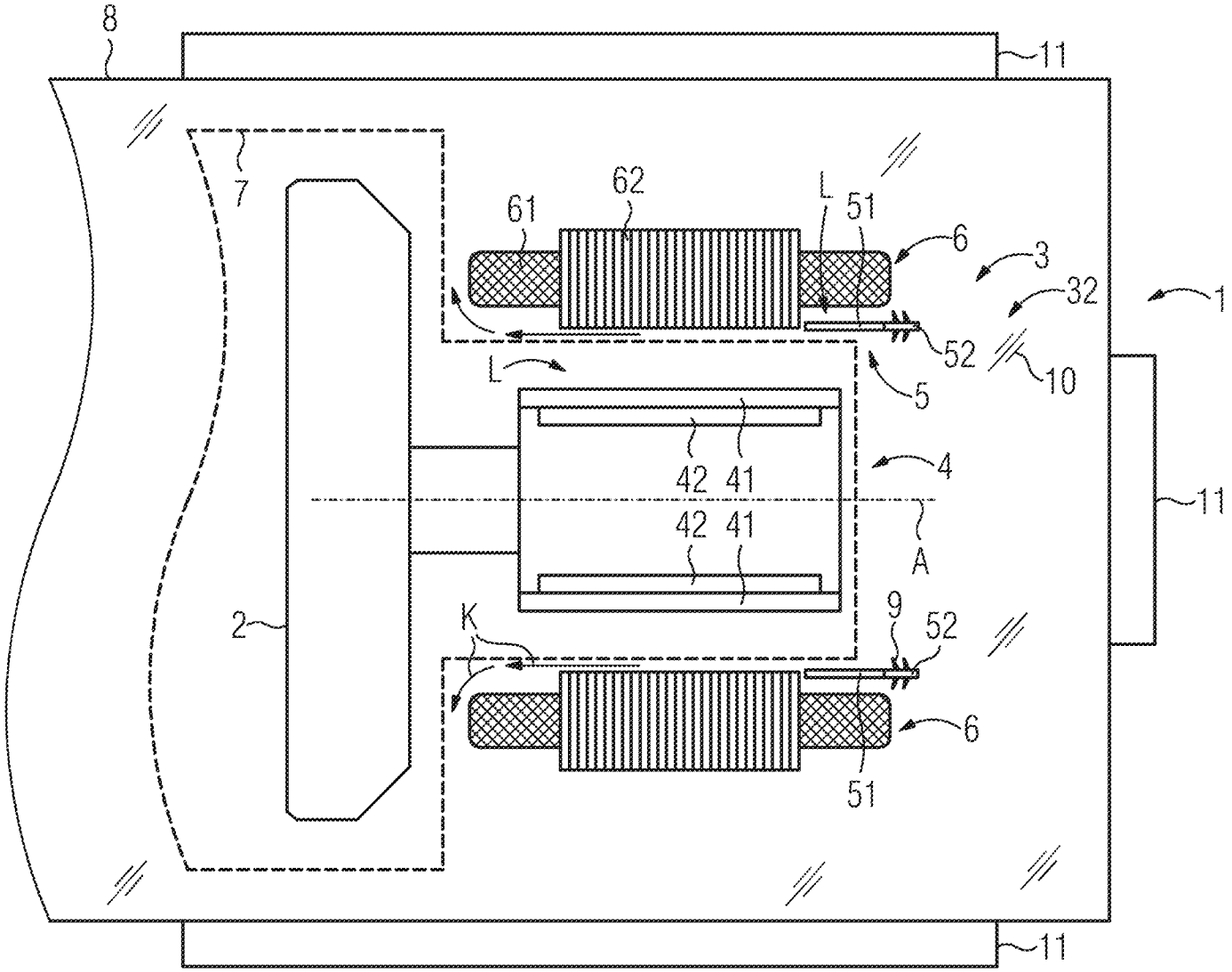

A particularly compact design is shown in FIG. 3. This differs from FIG. 2 in that the second rotor 5 is not disposed radially to the axis of rotation around the stator 6, but that the second rotor is disposed in the air gap L between the first rotor 4 and the stator 6 and encloses the first rotor 4 radially at least in sections in the axial direction. In all other respects the statements relating to FIG. 2 apply.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An X-ray source device, comprising:

an anode configured to generate X-rays;

a drive configured to rotate the anode about an anode central axis, the drive including a stator, a first rotor and a second rotor, and the first rotor being rotationally fixed relative to the anode; and a cooling facility configured to cool at least one of the anode or the drive using a coolant, the second rotor being configured to circulate the coolant, wherein the drive is an axial flux machine, the first rotor being on a side of the stator closer to the anode in a direction of the anode central axis, and the second rotor being on a side of the stator farther from the anode in the direction of the anode central axis.

2. The X-ray source device of claim 1, wherein the second rotor includes at least one circulating element to cause the coolant to circulate when the second rotor rotates.

3. The X-ray source device of claim 2, wherein the at least one circulating element is configured to move the coolant along a housing at least in sections.

4. The X-ray source device of claim 3, wherein the at least one circulating element is configured to move the coolant along the housing at least in the sections in a laminar manner.

5. The X-ray source device of claim 4, wherein the at least one circulating element includes at least one of a vane or a fin.

6. The X-ray source device of claim 2, wherein a first air gap is formed between the stator and the first rotor; and a second air gap is formed between the stator and the second rotor, the first air gap being wider than the second air gap.

7. The X-ray source device of claim 6, wherein a width of the second air gap is 0.01 to 0.5 times a width of the first air gap.

8. The X-ray source device of claim 2, wherein the at least one circulating element includes at least one of a vane or a fin.

9. The X-ray source device of claim 1, wherein the anode and the first rotor are inside an evacuatable housing; and the stator and the second rotor are outside of the evacuatable housing.

10. The X-ray source device of claim 9, wherein the evacuatable housing is evacuated.

11. The X-ray source device of claim 9, wherein the second rotor includes at least one circulating element to cause the coolant to circulate when the second rotor rotates; and the at least one circulating element is configured to move the coolant along the evacuatable housing at least in sections.

12. The X-ray source device of claim 11, wherein the at least one circulating element is configured to move the coolant along the evacuatable housing at least in the sections in a laminar manner.

13. The X-ray source device of claim 1, wherein a first air gap is formed between the stator and the first rotor; and a second air gap is formed between the stator and the second rotor, the first air gap being wider than the second air gap.

14. The X-ray source device of claim 13, wherein a width of the second air gap is 0.01 to 0.5 times a width of the first air gap.

15. The X-ray source device of claim 1, wherein the first rotor, the second rotor and the stator are enclosed by an external housing, the external housing being configured to separate the X-ray source device from an external environment, the external housing including at least one heat exchange element, and the at least one heat exchange element being designed to dissipate heat supplied by the coolant to the external environment.

16. An X-ray source device, comprising:

an anode configured to generate X-rays;

a drive configured to rotate the anode about an anode central axis, the drive including a stator, a first rotor and a second rotor, and the first rotor being rotationally fixed relative to the anode; and a cooling facility configured to cool at least one of the anode or the drive using a coolant, the second rotor being configured to circulate the coolant, wherein the drive is a radial flux machine, the anode central axis is essentially identical to an axis of rotation of the first rotor, the stator encloses the first rotor radially with respect to the anode central axis, and the second rotor encloses the stator radially with respect to the anode central axis.

17. The X-ray source device of claim 16, wherein the second rotor includes at least one circulating element to cause the coolant to circulate when the second rotor rotates.

18. The X-ray source device of claim 16, wherein the anode and the first rotor are inside an evacuatable housing; and the stator and the second rotor are outside of the evacuatable housing.

19. The X-ray source device of claim 18, wherein the at least one circulating element is configured to move the coolant along a housing at least in sections.

20. An X-ray source device, comprising:

an anode configured to generate X-rays;

a drive configured to rotate the anode about an anode central axis, the drive including a stator, a first rotor and a second rotor, and the first rotor being rotationally fixed relative to the anode; and a cooling facility configured to cool at least one of the anode or the drive using a coolant, the second rotor being configured to circulate the coolant, wherein the drive is a radial flux machine, the anode central axis is essentially identical to an axis of rotation of the first rotor, the stator encloses the first rotor radially with respect to the anode central axis, and the second rotor is radially between the first rotor and the stator.

21. The X-ray source device of claim 20, wherein the second rotor includes at least one circulating element to cause the coolant to circulate when the second rotor rotates.

22. The X-ray source device of claim 20, wherein the anode and the first rotor are inside an evacuatable housing; and the stator and the second rotor are outside of the evacuatable housing.

23. The X-ray source device of claim 22, wherein the at least one circulating element is configured to move the coolant along a housing at least in sections.

* * * * *